United States Patent [19]

Hutchins et al.

[11] 4,441,759

[45] Apr. 10, 1984

[54] IN SITU OIL SHALE RETORT SYSTEM

[75] Inventors: Ned M. Hutchins; Irving G. Studebaker, both of Grand Junction, Colo.; Rudolf Kvapil, Tucson, Ariz.; Thomas E. Ricketts, Grand Junction, Colo.

[73] Assignee: Occidental Oil Shale, Inc., Grand Junction, Colo.

[21] Appl. No.: 316,351

[22] Filed: Oct. 29, 1981

[51] Int. Cl.[3] ..... E21B 43/247; E21C 41/10

[52] U.S. Cl. ..... 299/2; 166/259; 299/19

[58] Field of Search ..... 299/2, 13, 19; 166/259

[56] References Cited

U.S. PATENT DOCUMENTS

| | | | |
|---|---|---|---|
| 4,043,595 | 8/1977 | French | 299/2 |
| 4,106,814 | 8/1978 | French | 299/2 |
| 4,140,343 | 2/1979 | Mills | 299/2 |
| 4,176,882 | 12/1979 | Studebaker et al. | 299/2 |
| 4,192,554 | 3/1980 | Ricketts | 299/2 |
| 4,219,237 | 8/1980 | Sisemore | 299/2 |
| 4,246,965 | 1/1981 | Cha | 299/2 X |
| 4,290,649 | 9/1981 | Ricketts | 299/2 |

FOREIGN PATENT DOCUMENTS

| | | | |
|---|---|---|---|
| 913644 | 8/1979 | Fed. Rep. of Germany | 299/2 |

OTHER PUBLICATIONS

"Geology, Hydrology, and Extraction Operations at the Occidental Petroleum Corporation Oil Shale Pilot Plant Near De Beque, Colorado", by Randall T. Chew, III; Guidebook to the Energy Resources of the Piceance Creek Basin, Colorado; Rocky Mountain Association of Geologists (1974).

*Primary Examiner*—George A. Suchfield

*Attorney, Agent, or Firm*—Christie, Parker & Hale

[57] ABSTRACT

In situ oil shale retorts are formed in spaced apart rows, with adjacent rows of such retorts being separated by load-bearing barrier pillars of unfragmented formation sufficiently strong for preventing substantial subsidence at the ground surface. Each retort contains a fragmented permeable mass of formation particles containing oil shale. Separate air level drifts are excavated on an upper level of the retorts within alternating barrier pillars, and separate production level drifts are excavated at a lower production level of the retorts within intervening barrier pillars between the barrier pillars having the air level drifts. Each air level drift extends between a pair of adjacent rows of retorts adjacent upper edges of the retorts in the adjacent rows, and each production level drift extends between a pair of adjacent rows of retorts adjacent lower edges of the retorts on sides of the retorts opposite the air level drifts. During retorting operations, air is introduced along the upper edge of each retort through lateral air inlet passages extending from the adjacent air level drift. Off gas and liquid products are withdrawn from each retort through one or more lateral production level passages extending from the lower edge of the retort to the adjacent production level drift. Withdrawal of off gas along the lower edge of each retort opposite the upper edge where air is introduced causes a generally diagonal flow pattern of combustion gas through the fragmented mass from one upper edge toward the opposite lower edge of the retort.

24 Claims, 9 Drawing Figures

IN SITU OIL SHALE RETORT SYSTEM

BACKGROUND OF THE INVENTION

1. Field of the Invention

This invention relates to in situ recovery of shale oil, and more particularly to techniques for recovering shale oil from a system of in situ oil shale retorts, while supporting overburden loads sufficiently to avoid substantial subsidence at the ground surface.

2. Description of the Prior Art

The presence of large deposits of oil shale in the semi-arid high plateau region of the Western United States has given rise to extensive efforts to develop methods for recovering shale oil from kerogen in the oil shale deposits. The term "oil shale" as used in the industry is in fact a misnomer; oil shale is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded for forming a fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone through the fragmented mass. In the combustion zone, oxygen from the retort inlet mixture is depleted by reaction with the hot carbonaceous material to produce heat, combustion gas and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to maximize sweep efficiency of gas flow through the fragmented mass in the retort and the amount of oil shale subjected to retorting within a region of formation being developed. To this end, it is sometimes desirable to minimize the amount of formation excavated from each retort site when forming void volumes in preparation for explosive expansion. The mined out formation is excluded from the in situ retorting process, which can reduce the overall recovery of shale oil from the retorts. Removed formation either must be retorted by above-ground techniques, or the shale oil is lost when the mined out material is discarded. Moreover, the steps of mining the shale and transporting it to above ground are expensive and time consuming.

It is also desirable to avoid significant uncontrolled subsidence at the ground surface in a tract of in situ oil shale retorts. There is a trade-off between extracting as much oil shale as possible to maximize resource recovery, and leaving sufficient unrecovered oil shale in the supporting pillars of unfragmented formation for supporting the weight of the overburden to avoid subsidence. Subsidence can result in fracturing of overburden with consequent leakage of water from overlying aquifers into retort or mining areas, leakage of gas from completed retorts, leakage of air into retorts during retorting operations, and safety hazards in underground workings containing operating personnel. Such subsidence can occur when the extraction ratio in the tract is large and the remaining unfragmented formation is not sufficient for supporting the weight of the overburden. For example, a fragmented mass having a substantial void fraction can have a substantially reduced compressive strength as compared with unfragmented formation. Because of the reduced structural support, subsidence of overburden can occur.

Techniques can be devised for developing a tract of in situ oil shale retorts so as to avoid substantial subsidence of overburden during the operating life of the retorts. To do so with the greatest degree of certainty for the ore reserve life calls for minimal reliance on support of overburden by the fragmented masses in the in situ retorts, with overburden loads being supported largely, if not entirely, by pillars of unfragmented formation between adjacent retorts.

A mining system for developing a tract of in situ oil shale retorts also must be economically feasible. For example, the mining and construction costs involved in preparing a system of in situ retorts can be reduced tremendously by eliminating or reducing the number of drift systems excavated at one or more levels within the retort system.

Thus, it is desirable to provide a technique for developing a tract of in situ oil shale retorts providing the appropriate support of overburden without significantly increasing mining costs. The system of developing the oil shale tract also should have a good configuration of the gas inlets and gas outlets for the in situ retorts for promoting high sweep efficiency of retorting gases and should promote efficient retorting of the fragmented masses and recovery of liquid and gaseous products from the retorts.

SUMMARY OF THE INVENTION

Briefly, one embodiment of this invention provides a system of in situ oil shale retorts formed within a subterranean formation containing oil shale. The retort system comprises a plurality of mutually spaced apart rows of in situ oil shale retorts, with load-bearing barrier pillars of unfragmented formation separating adjacent rows of such in situ retorts from one another. The load-bearing pillars are sufficiently strong for preventing substantial subsidence of overburden at elevations above the upper boundaries of the in situ retorts. Separate air level drifts are excavated in alternating barrier pillars between adjacent rows of retorts. The air level drifts extend adjacent upper edges of the retorts in the adjacent rows of retorts. Separate production level drifts are excavated in intervening barrier pillars between the barrier pillars in which the air level drifts are excavated. The production level drifts extend between adjacent rows of retorts and adjacent lower edges of the retorts in the adjacent rows, on the sides of the retorts opposite the sides adjacent to the air level drifts. Fluid communication is provided between each air level drift and upper edges of retorts in the rows of retorts adjacent the air level drift. Fluid communication is also provided between the production level drift and lower edges of retorts in the rows of retorts adjacent the production level drift. In one method of conducting retorting operations in the retort system, oxygen supplying gas is introduced into the upper edges of the retorts from the air level drift, and off gas is withdrawn from the opposite lower edges of the retorts to the production level drift. This produces a gas flow pattern through the retorts which advances a retorting zone diagonally through the retorts from the upper edges near the air level drift toward the opposite lower edges near the production level drift.

Such a system of providing air level drifts and production level drifts in alternating load-bearing pillars of unfragmented formation can provide appropriate support for overburden loads to avoid subsidence at the ground surface without significantly increasing the costs of mining. The system is economical in terms of mining costs, insamuch as only one air level drift and one production level drift are required for two adjacent rows of retorts. The air level drift and product level drift can be used for excavation of the upper and lower voids in the in situ oil shale retort sites. This avoids need for separate levels for mining and for inlet and outlet gas flows, thereby minimizing total mining costs. The diagonal gas flow pattern can promote efficient retorting of the fragmented masses by minimizing the effects of any void fraction maldistribution within the fragmented masses in the retorts.

DRAWINGS

These and other aspects of the invention will be more fully understood by referring to the following detailed description and the accompanying drawings in which:

FIG. 9 is a schematic illustration similar to FIG. 5, but illustrating a system for developing an array of relatively shorter retorts according to principles of this invention.

DETAILED DESCRIPTION

Figure 1:
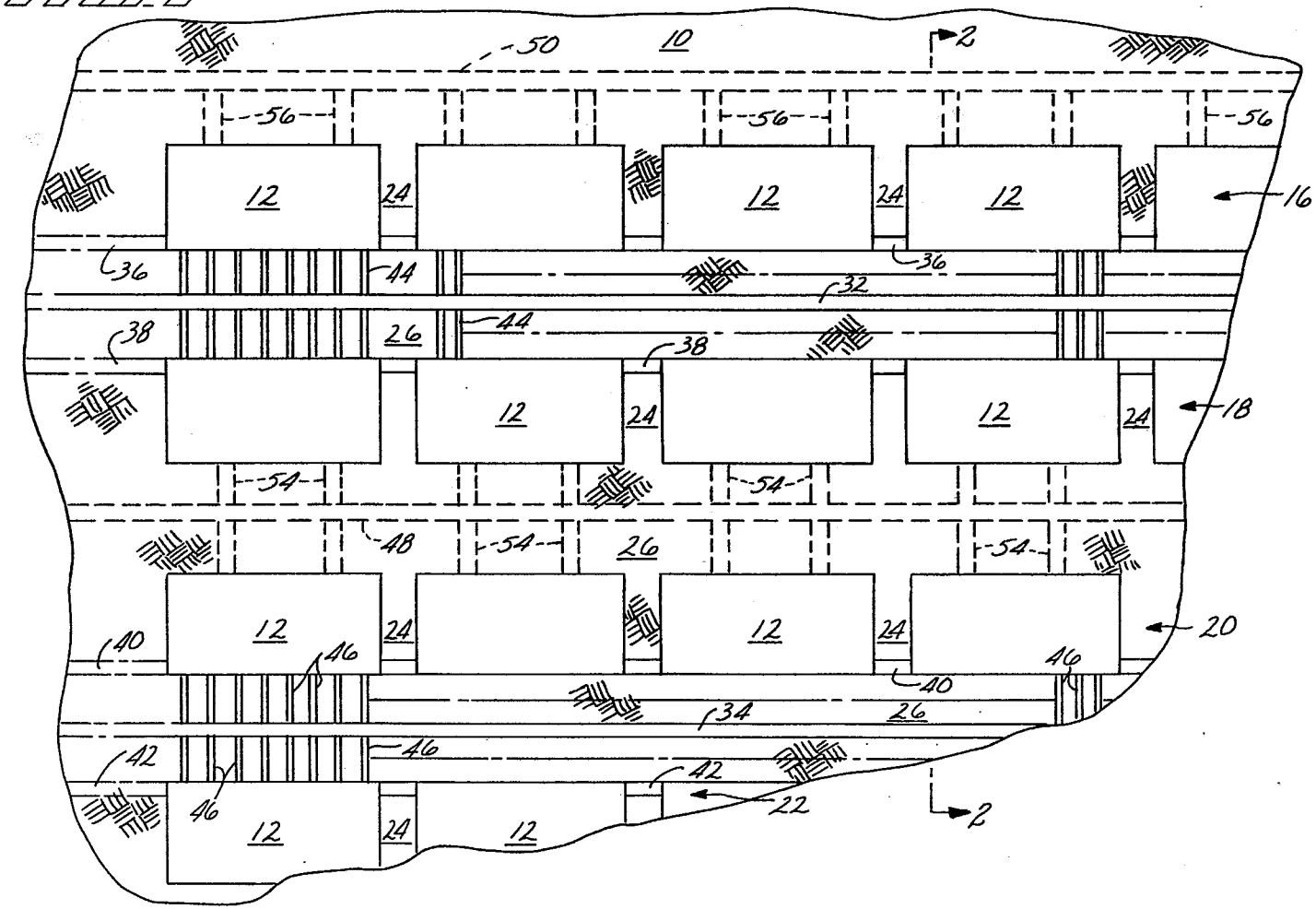
FIG. 1 is a fragmentary semi-schematic horizontal cross-sectional plan view illustrating a system of in situ oil shale retorts formed according to principles of this invention.

FIG. 1 is a plan view, in horizontal cross section, semi-schematically illustrating an in situ oil shale retort system formed in a subterranean formation 10 containing oil shale. The illustrated embodiment is a small area of an oil shale tract, indicating locations of several rows of in situ oil shale retorts 12 formed in the subterranean formation.

Figure 2:
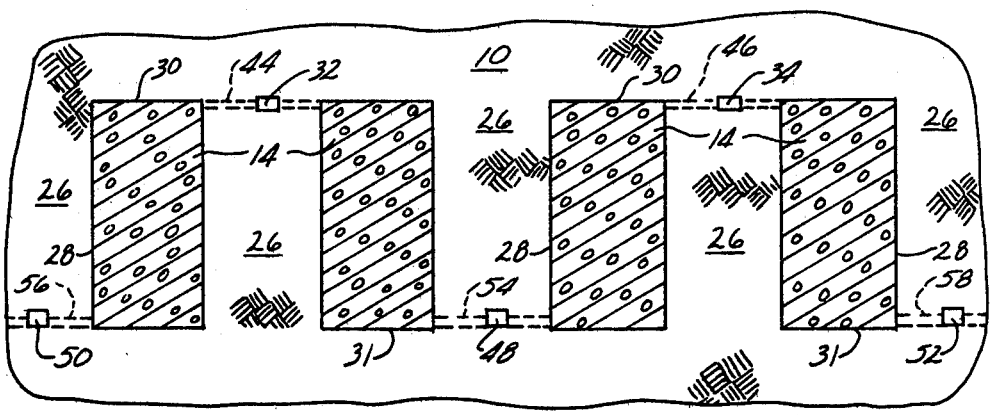
FIG. 2 is a fragmentary, semi-schematic vertical cross section taken on line 2-2 of FIG. 1.

The individual in situ oil shale retorts, when completed by explosive expansion techniques, comprise a fragmented permeable mass 14 of formation particles containing oil shale, as illustrated schematically in FIG. 2. The fragmented masses are not illustrated in FIG. 1 for clarity. In preparing each retort for explosive expansion, formation from within the boundaries of each retort site is excavated to form at least one void, leaving a remaining portion of unfragmented formation within the boundaries of the retort site.

The remaining portion of unfragmented formation is explosively expanded toward such a void to form the fragmented mass within the retort boundaries.

The in situ retorts 12 are arranged in parallel rows 16, 18, 20, 22, or retorts, also referred to herein as first, second, third and fourth rows of retorts. The rows of retorts are horizontally spaced apart substantially equidistantly from one another. The retorts within each row also are horizontally spaced apart substantially equidistantly from one another along the length of the row. In the illustrated embodiment, the retorts are generally rectangular in horizontal cross section and the retorts are arranged in each row so the long dimensions of the retorts are aligned along the length of each row.

Vertically extending partitions or gas barriers 24 of unfragmented formation are left between the end boundaries of adjacent fragmented masses in each row. Load-bearing barrier pillers 26 of unfragmented formation are interleaved between adjacent rows of retorts in the oil shale tract. The barrier pillars are generally uniform in width with respect to one another and are sufficiently wide to provide support for overburden above the upper boundaries of the retorts. The retort system is a "non-subsiding" arrangement in which subsidence of overburden is minimized by the load-supporting barrier pillars. The pillars are sufficiently strong for preventing substantial subsidence at the ground surface. The required width of the barrier pillars is dependent upon the depth below the ground surface, properties of the unfragmented formation, and the like, and can be estimated by well known geologic techniques.

The load-bearing pillars also act as gas barriers to isolate retorting operations in the fragmented masses within each row from retorting operations in adjacent rows. The narrow partitions or gas barriers of unfragmented formation 24 which separate the fragmented masses within each row also act as a gas seal for isolating retorting operations in the fragmented masses within each row from one another. The partitions are non-load bearing, i.e., they can be sufficiently thin that they do not provide significantly more support for overburden than the adjacent fragmented masses.

In the illustrated embodiment, which is but one example of possible arrangements of the in situ retort system, the retorts are relatively long and narrow, with dimensions that can be about 155 feet wide and 310 feet or more long. An exemplary height for such retorts is in the range of about 200 to 400 feet. The barrier pillars 26 of unfragmented formation which separate adjacent rows of retorts are about 150 feet thick. In this arrangement, where the thickness of the barrier pillar is about the same order of thickness as the adjacent fragmented masses, and the extraction ratio in forming the retort system is about 50 percent, the barrier pillars have sufficient load-bearing capability to support overburden loads without substantial subsidence at the ground surface. The partitions or gas barriers 24 between adjacent retorts in each row can be about 50 feet thick, which provides adequate gas seals between retorts for isolating retorting operations. A partition of this thickness is not considered to be load-bearing. The partitions 24 between retorts within a row may actually bear some overburden load, but they can be considered non-load bearing since the barrier pillars 26 between rows are sufficient for bearing the overburden loads without substantial subsidence throughout the use for life of the region being developed. The dimensions in this embodiment are exemplary only and are set forth for the purpose of indicating principles of this invention.

FIG. 2 is a vertical cross section of the retorts along line 2-2 of FIG. 1, with the cross section being taken through one retort in each row. The fragmented masses 14 are formed within vertical side boundaries 28 of each retort site. Each retort has a generally horizontal upper boundary 30 and the generally horizontal lower boundary 31. The upper and lower boundaries of retorts in adjacent rows generally lie within common upper and lower horizontal planes. In an alternative configuration, retorts in adjacent rows can have sloping lower boundaries with the lower boundaries of retorts in one row sloping downwardly toward retorts in an adjacent row.

Separate air level drifts are excavated at an upper level of the retorts between adjacent rows of retorts within alternating barrier pillars. Referring to the embodiment of FIGS. 1 and 2, a first air level drift 32 is excavated within the barrier pillar between the first and second rows 16, 18 of retorts; and a second air level drift 34 is excavated within the barrier pillar between the third and fourth rows 20, 22 of retorts. Each air level drift extends the length of the adjacent rows of retorts. Thus, the air level drifts extend parallel to one another across the retort tract. Each air level drift also is excavated approximately equidistantly from the retorts in the adjacent rows of retorts. Since the air level drifts are excavated only in every second support pillar, the intermediate support pillars are essentially intact at the air level.

Development drifts at the air level extend along each row of retorts through the respective retort sites to provide communication between a peripheral air level drift (not shown in FIGS. 1 and 2) and the upper level of the retorts. In the embodiment of FIGS. 1 and 2, first and second development drifts 36, 38 extend parallel to one another through retort sites in the first and second rows of retorts, respectively. Similarly, development drifts 40, 42 extend parallel to one another through retort sites in the third and fourth rows 20, 22 of retorts, respectively. The development drifts provide access to excavate void spaces at the air level within each retort site, to drill shot holes downwardly into the retort volume, and otherwise to assist in preparation of the retorts.

Lateral air inlet passages such as spaced apart bore holes 44 are drilled outwardly from opposite sides of the first air level drift to the nearest upper edges of each retort in the first and second rows 16, 18 of retorts. Similar lateral air inlet passages or bore holes 46 are drilled outwardly from opposite sides of the second air level drift to the nearest upper edges of each retort in the third and fourth rows 20, 22. In the illustrated embodiment, there are eight equidistantly spaced apart bore holes drilled from the air level drift into the upper edge of each retort. The lateral air inlet passages provide fluid communication between each air level drift and the upper edges of the retorts in the rows adjacent the drift. Thus, the bore holes can be used for supplying air to the fragmented masses, at spaced apart locations along the length of the fragmented masses, during a subsequent retorting operation.

Separate production level drifts are excavated at a lower production level of the retorts between rows of retorts in intervening barrier pillars between the barrier pillars in which the air level drifts are excavated. The illustrated embodiment shows a production level drift 48 excavated between the second and third rows 18, 20 of retorts and extending along the length of the adjacent rows of retorts. The production level drift is excavated generally equidistantly from the second and third rows of retorts and is preferably excavated adjacent the bottom boundaries of the retorts in the adjacent rows, although the production level drift can be excavated at an elevation spaced below the bottom boundaries of the adjacent retorts, if desired. FIG. 2 illustrates additional production level drifts 50 and 52 similarly extending between rows of retorts in support pillars that do not include the air level drifts. Thus, each support pillar has either an air level drift or a production level drift. Alternate pillars have one or the other of such drifts and none of the pillars has both. Stated another way, each row of retorts has a production level drift excavated along a side of the retort that is opposite from the side that receives air from the air level drift system.

Lateral product withdrawal drifts 54 extend between the production level drift 48 and the nearest lower edge of each of the retorts in the second and third rows of retorts. Lateral product withdrawal drifts 56 and 58 at the production level also are excavated between the production level drifts 50, 52 and the nearest lower edges of the retorts in the adjacent rows of retorts. A pair of parallel lateral product withdrawal drifts are shown extending from each retort to an adjacent production level drift, although a different number of such lateral drifts can be used at the production level, if desired. The lateral product withdrawal drifts 54, 56 and 58 provide access to a lower portion of the adjacent retort for excavating formation for forming a lower void space within the retort volume. The lateral drifts also provide a means for withdrawing liquid and gaseous products of retorting from adjacent lower edges of retorts in the rows of retorts on opposite sides of each production level drift.

After void spaces are excavated within each retort site at the air level and the production level, the remaining formation within the retort site is explosively expanded toward such voids. If desired for a system of tall retorts, a void space also can be excavated at an intermediate level between the air level void and the production level void, as described in greater detail below with respect to FIGS. 5 through 8. Within each of the voids formed within each retort site, temporary roof supporting pillars of unfragmented formation can be left in place during mining operations. Such pillars, if present, are explosively expanded before the formation between the voids is expanded. Explosive expansion of the pillars and intervening zones of formation between the voids can be in a single round of explosions, or as a series of separate explosions.

During retorting operations, air or other exygen supplying gas is introduced to the upper edge of the fragmented mass of each retort from the adjacent air level drift via the air inlet passages. Formation particles at the top of the fragmented mass are ignited to establish a combustion zone at the top of the fragmented mass. The air or other oxygen supplying gas introduced along the upper edge of the fragmented mass sustains the combustion zone and causes it to advance through the fragmented mass. Combustion gas produced in the combustion zone passes through the fragmented mass to establish a retorting zone on the advancing side of the combustion zone where kerogen in the fragmented mass is converted to liquid and the gaseous products of retorting. Liquid products, namely, shale oil and water, and off gas produced during operation of each retort are withdrawn from the fragmented mass through the lateral product withdrawal drifts at the lower edge of each retort opposite from the upper edge at which air is received from the air level drift system. The gas flow through the fragmented mass is generally diagonally, across the width (or short dimensions of the retort) from the upper edge of the side boundary adjacent the air level drift toward the lower edge of the opposite side boundary of the fragmented mass. The shale oil, water, and off gas can be withdrawn separately from the production level drift and passed to above ground.

Figure 4:
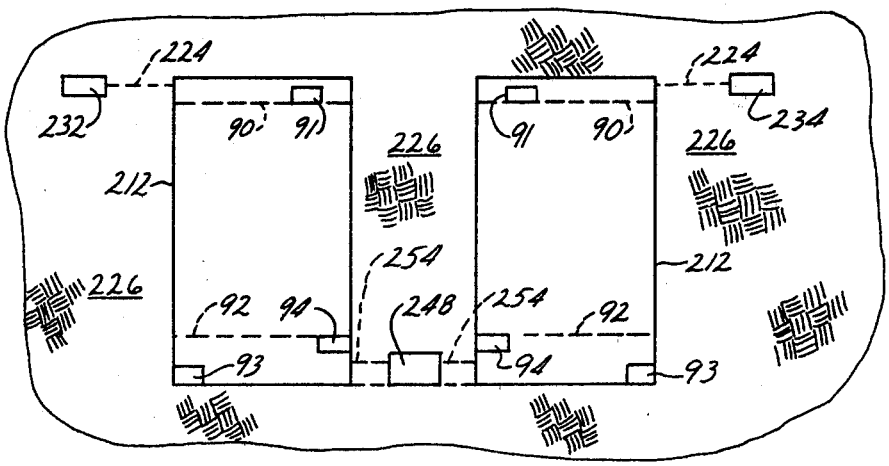
FIG. 4 is a schematic diagram of a vertical cross section, taken on line 4-4 of FIG. 3, illustrating exemplary streamlines for gas flow through the retort.
Figure 3:
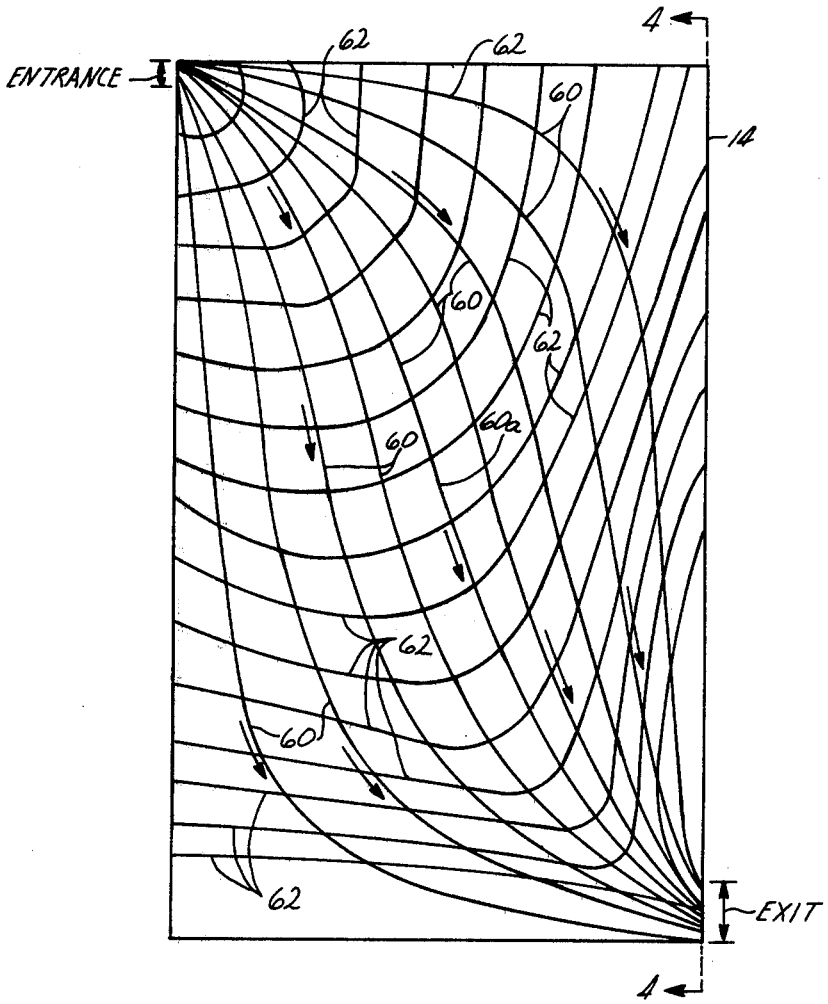
FIG. 3 is a schematic diagram of a vertical cross section through such a retort illustrating exemplary streamlines for gas flow and progress of a combustion zone through the fragmented mass in the retort.
Figure 4:
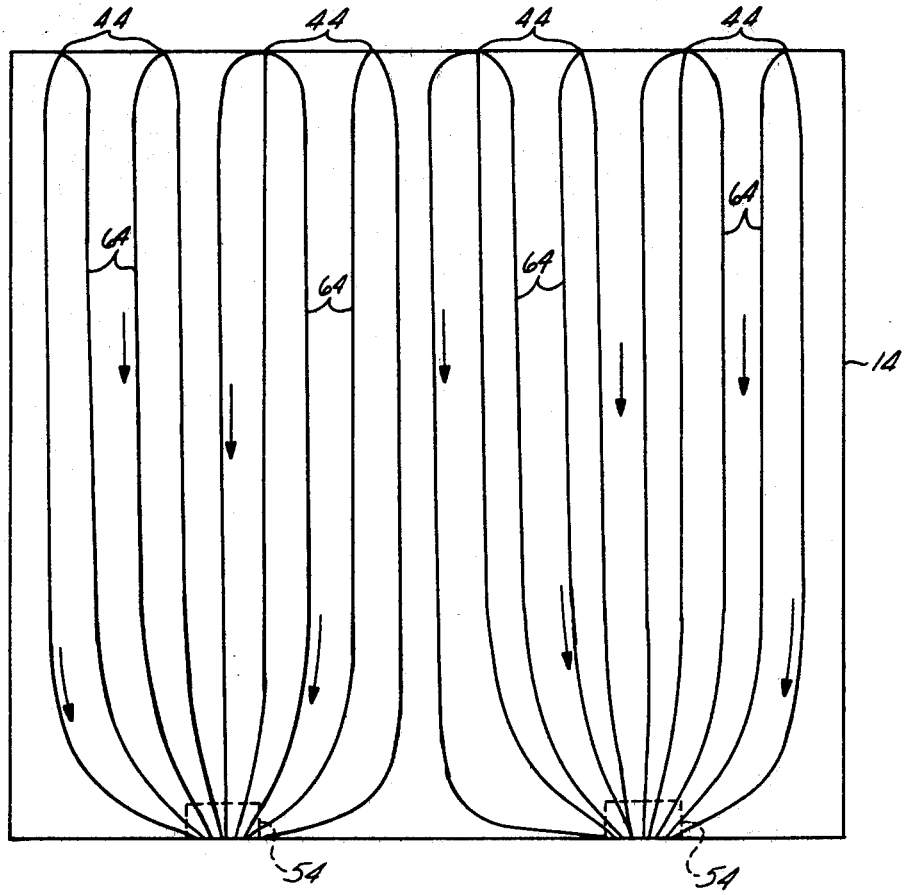
Figure 5:
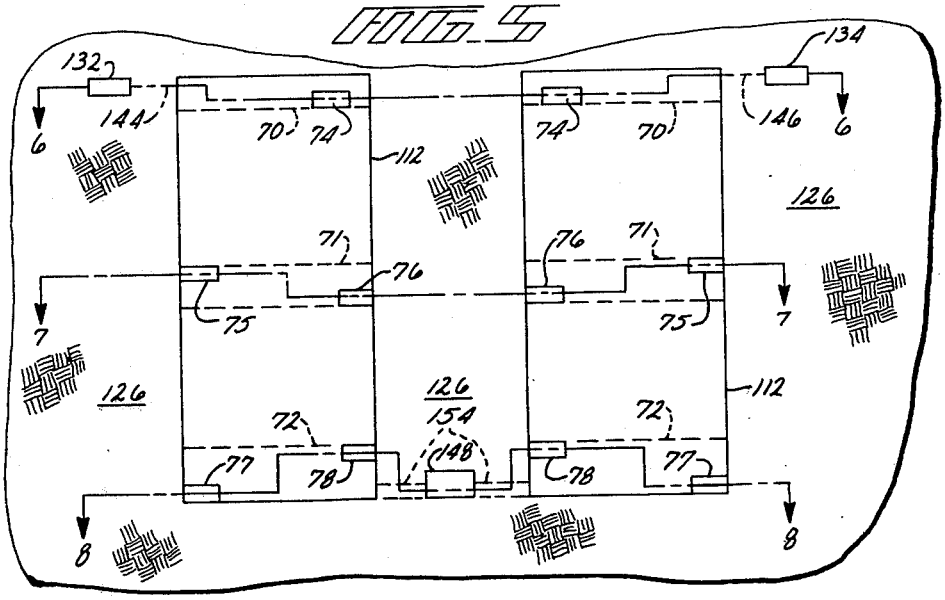
FIG. 5 is a schematic illustration of one embodiment of a mining system for developing an array of relatively taller retorts according to principles of this invention.

FIGS. 3 and 4 schematically illustrate the gas flow paths and approximate locus of the combustion zone, as a function of time, as the combustion zone advances diagonally through the retort. This diagonal gas flow pattern has been determined mathematically and is illustrated schematically in FIG. 3 as being along a plurality of streamlines 60 extending from the inlets along the upper edge of the retort to the outlets at the opposite lower edge of the retort. The view of FIG. 3 is a vertical cross section of a retort in the system of FIGS. 1 and 2 looking along the length of a row of retorts, with the inlets at the upper left corner and the outlets at the lower right corner of a given retort. The pattern in FIG. 3 is idealized as if there were a continuous inlet along one upper edge and a continuous outlet along the opposite lower edge. Each streamline is drawn so that each portion along its length is generally perpendicular to lines of equal pressure through the retort. The lines of equal pressure, i.e., isobars, are not shown since they are not needed for an understanding of this concept. It is believed that a portion of the gas introduced into the retort travels along each streamline through the fragmented mass from the upper inlets toward the lower outlets. Gas flow, therefore, passes generally diagonally through the retort from the retort inlets to the retort outlets along each streamline. The streamlines 60 depicted in FIG. 3 are those that occur at 10 percent intervals of the gas flow through the fragmented mass; that is, for example, for the second streamline, 20% of the gas flows through the area to the left of the line and 80% through the area to the right.

Theoretically, the gas velocity along each streamline is approximately inversely proportional to the length of the streamline. Further, it has been estimated theoretically and determined by experiment that the rate of flame front or combustion zone advancement through the fragmented mass is proportional to the gas velocity.

In the embodiment illustrated in FIG. 3, lines 62 indicate the shape and movement of the combustion zone at series of time intervals during retorting operations, as the combustion zone advances from the inlets diagonally downwardly through the fragmented mass to the outlets. At least a portion of the combustion zone is skewed from horizontal throughout the advancement of the combustion zone through the fragmented mass.

FIG. 4 illustrates approximate streamlines 64 for diagonal gas flow through the retort viewed in a direction that is orthogonal with respect to the view of FIG. 3. The streamlines illustrated in the diagram of FIG. 4 correspond to the gas flow pattern along the 50 percentile streamline **60*a* illustrated in FIG. 3. The diagram of FIG. 4 illustrates how the streamlines flow away from the inlet openings from the air inlet passages 44 spaced apart across the upper edge of the retort and converge downwardly toward the pair of lateral outlet drifts 54** spaced apart along the opposite lower edge of the retort.

The gas flow distribution illustrated in FIGS. 3 and 4 is estimated for generally uniform void fraction distribution or uniform permeability in the fragmented mass in the retort. The retort is also substantially filled to the top boundary with fragmented formation particles.

It is believed that the diagonal gas flow pattern through the retort from an upper edge toward an opposite lower edge tends to minimize the effects of any void fraction maldistribution that may be present within the fragmented mass in the retort. That is, regions of void fraction maldistribution, such as areas of high permeability that can lead to gas channelling, may tend to extend generally vertically through the fragmented mass. By advancing the combustion zone diagonally across the retort at an angle to such vertical regions, as opposed to parallel to them, it is believed that sufficient resistance to gas flow through the fragmented mass can be produced to advance the combustion zone reasonably uniformly through the fragmented mass. This alleviates the effects of gas channelling, particularly in an embodiment with non-uniform permeability where the paths with highest permeability correspond to the longest flow streamlines. Diagonal gas flow through an in situ oil shale retort is described and claimed in our copending U.S. Patent application Ser. No. 273,964, filed June 15, 1981, entitled "In Situ Oil Shale Retort With Diagonal Gas Flow" now abandoned.

The techniques of this invention can be used for developing a system of relatively taller retorts, as depicted in FIGS. 5 through 8, or such techniques can be used for developing a system of relatively shorter retorts, as depicted in FIG. 9. An exemplary height of such relatively taller retorts is about 370 to 430 feet, and an exemplary height of such relatively shorter retorts is about 250 to 310 feet. In each case the retorts in horizontal cross section can be about 155 feed wide and about 310 feet or more long, as in the embodiment of FIGS. 1 and 2.

FIGS. 5 through 8 also illustrate how a plurality of retorts, according to principles of this invention, can be operated together as a module during retorting operations. In the illustrated embodiment, two adjacent rows of retorts on opposite sides of a production level drift comprises one module of retorts. In the embodiment of FIGS. 5 through 8, reference numerals corresponding to elements depicted in FIGS. 1 and 2 are increased by 100. The retort system is developed by a horizontal free face system in which upper, intermediate and lower void spaces (represented schematically at 70, 71, and 72, respectively), are excavated across upper, intermediate, and lower levels of each retort site. An upper level development drift 74 spaced inwardly from a side boundary of the retorts is excavated along an upper level of each row of retorts to provide access for forming the upper level void space within each retort site. A pair of intermediate level development drifts 75, 76 are excavated at different intermediate levels along opposite sides of each row of retorts for providing access for forming the intermediate level void spaced within each retort site. Similarly, a pair of lower level development drifts 77, 78 are excavated at different lower levels along opposite sides of each row of retorts for providing access for forming the lower level void spaces within each retort site.

Figure 6:
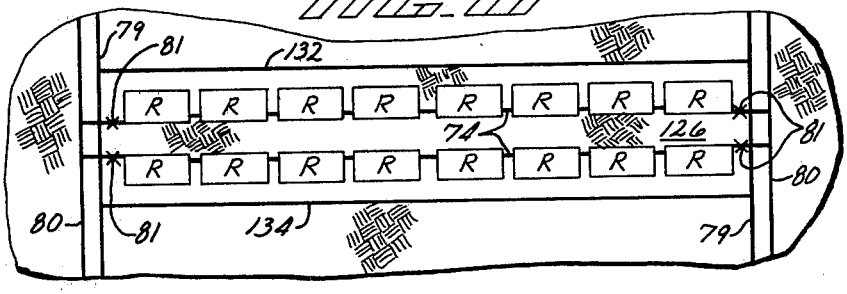
FIG. 6 is a schematic illustration, taken on line 6-6 of FIG. 5, illustrating the development of the retorts at an air level.

As shown best in FIG. 6, the upper level development drift 74, which extends along each row of retorts through the respective retort sites, provides communication between a pair of parallel inner and outer peripheral air level drifts 79, 80 at each end of the rows of retorts within a given module. The air level drifts 132, 134 which extend along opposite outer sides of the two rows of retorts within the module connect to the inner peripheral air level drifts 79 by drifts or boreholes (not shown). Bulkheads 81 close off the upper level development drifts at opposite ends of the module to seal against entry of off gas into the peripheral air level drifts.

Figure 7:
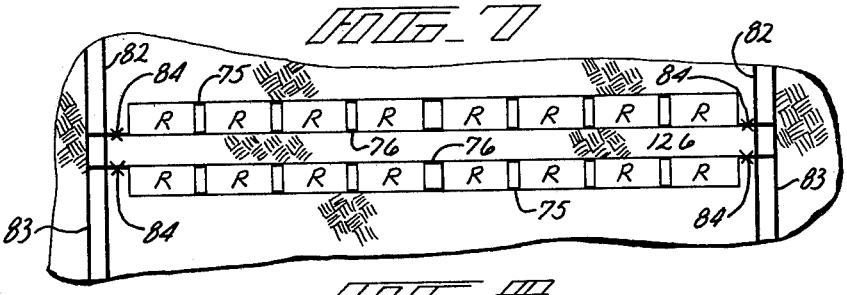
FIG. 7 is a schematic illustration, taken on line 7-7 of FIG. 5, illustrating development of the retorts at an intermediate level.

As illustrated in FIG. 7, the intermediate level development drifts 75, 76 provide communication between a pair of parallel inner and outer peripheral intermediate level drifts 82, 83 at opposite ends of the two rows of retorts within the module. Bulkheads 84 close off opposite ends of the intermediate level drifts to seal against entry of off gas into the peripheral intermediate level drifts.

Figure 8:
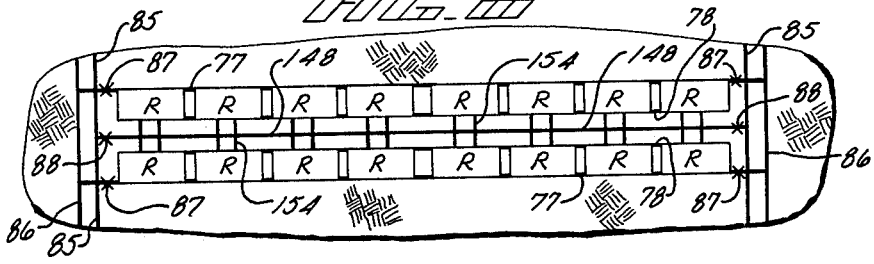
FIG. 8 is a schematic illustration, taken on line 8-8 of FIG. 5, illustrating development of the retorts at a production level.

FIG. 8 illustrates the production level at which the lower level development drifts 77, 78 provide communication between a pair of parallel inner and outer peripheral lower level drifts 85, 86 at opposite ends of the two rows of retorts within the module. Bulkheads 87 close off opposite ends of the lower level development drifts 77 to seal against entry of off gas into the inner and outer peripheral lower level drifts 85, 86. Bulkheads 88 at opposite ends of the production level drift 148 seal against entry of off gas into the peripheral lower level drifts 85, 86.

FIG. 9 illustrates a system for developing a module containing relatively shorter retorts in which void spaces are formed within the retort site by a horizontal free face system of upper and lower void spaces, i.e., without an intermediate void space. In the system illustrated in FIG. 9, upper level void spaces 90 are formed by access provided by upper level development drifts 91 extending the length of the row of retorts. Lower level void spaces 92 are formed by access provided by lower level access drifts 93, 94 excavated at different lower levels along opposite sides of the row of retorts.

During retorting operations, the retorts within both rows of retorts, as depicted in FIGS. 6 through 8, can be operated together as a module in the sense that off gas and liquid products from the two rows of retorts on opposite sides of the production level drift are withdrawn to the common production level drift system and commingled in the production level drift system. Individual retorts can be isolated from one another by forming gas seals in the development drifts, at the air level, the intermediate level and the production level, between adjacent retorts in each row. By operating the retorts at a pressure less than the pressure in the air level drifts, air can be introduced to the tops of the active retorts on one side of the air level drift without hazard to operations being conducted in the air level drift and in retorts along the opposite side of the same air level drift.

Thus, the techniques of this invention enable development of a system of in situ oil shale retorts while providing the necessary support for overburden. The mining costs of developing the retort system are minimized because a single air level drift communicates with two rows of retorts on opposite sides of the drift, and products of retorting are withdrawn from two rows of retorts to a single production level drift. The technique of advancing the combustion zone through the retorts along a diagonal path also can promote effective retorting of the fragmented masses in the retorts.

Many additional modifications and variations will be apparent. For example, in the illustrated embodiment, the air level drifts in the intervening pillars are at about the same elevation as the tops of the retorts; whereas, if desired such air level drifts adjacent the upper boundaries of the retorts can advantageously be spaced at elevations above the upper boundaries of adjacent retorts. In such an embodiment, the bore holes 44 can slant downwardly from the air level drift to the upper edge of an adjacent retort. If desired instead of a single air level drift in the barrier pillar between retorts, a pair of parallel interconnected drifts can be excavated. Such can be advantageous for mine safety and ventilation reasons. A similar dual drift system can be used at the production level and the production level drifts can be spaced below the elevation of the bottoms of adjacent retorts with slanting interconnections to an adjacent lower edge of such a retort. Thus, the air level and production level drifts are considered to be "in" the respective pillars when in the same location in a horizontal direction whether at the same elevation as the adjacent top or bottom boundary of the retort or at somewhat higher or lower elevations. The retorts can have a square horizontal cross section instead of the elongated rectangular cross section illustrated. A larger or smaller number of gas inlets and product outlets can be used. Instead of the drifts illustrated at the production level, slanting boreholes could be used similar to the boreholes 46 illustrated at the air level. Many other variations can be provided and it is to be understood that the scope of this invention is as set forth in the following claims.

What is claimed is:

1. A system of in situ oil shale retorts formed within a subterranean formation containing oil shale, such an in situ oil shale retort having upper, lower, and side boundaries of unfragmented formation and containing a fragmented permeable mass of formation particles containing oil shale, the retort system comprising:

a plurality of mutually spaced apart rows of such in situ oil shale retorts;

load-bearing barrier pillars of unfragmented formation separating adjacent rows of such in situ retorts from one another, such load-bearing barrier pillars being sufficiently strong for preventing substantial subsidence of overburden at elevations above the upper boundaries of such in situ oil shale retorts;

separate air level drifts excavated in alternating barrier pillars and extending along the length of such pillars between adjacent rows of such retorts adjacent upper edges of the retorts in such adjacent rows;

separate production level drifts excavated along the length of intervening barrier pillars between the barrier pillars in which the air level drifts are excavated, the production level drifts being between adjacent rows of retorts and extending adjacent lower edges of the retorts in such adjacent rows, said lower edges being on opposite sides of such retorts from the sides adjacent the air level drifts;

means for providing fluid communication between such an air level drift and adjacent upper edges of retorts in the rows of retorts adjacent such air level drift; and means for providing fluid communication between such a production level drift and adjacent lower edge of retorts in the rows of retorts adjacent such production level drift.

2. The system according to claim 1 including a plurality of inlet passages spaced apart along the upper edge of such an in situ retort for providing fluid communication between the air level drift and such retort.

3. The system according to claim 1 in which retorts in each row are separated by partitions of unfragmented formation for substantially preventing gas flow between adjacent retorts in each row but which do not provide significantly more support for overburden loads than the adjacent fragmented masses.

4. A system of in situ oil shale retorts formed within a subterranean formation containing oil shale, such an in situ oil shale retort having upper, lower and side boundaries of unfragmented formation containing a fragmented permeable mass of formation particles containing oil shale, the retort system comprising:

a plurality of mutually spaced apart generally parallel rows of in situ oil shale retorts, such retorts being generally rectangular in horizontal cross section and having a longer length and a shorter width, the retorts in each row being arranged with their lengths extending generally parallel to the length of the row of retorts;

load-bearing barrier pillars of unfragmented formation separating adjacent rows of such in situ retorts from one another, such load-bearing pillars being sufficiently strong for preventing substantial subsidence of overburden at elevations above the upper boundaries of such in situ retorts;

separate air level drifts extending along the length of alternating barrier pillars between adjacent rows of such retorts adjacent upper edges of retorts in such adjacent rows, said upper edges extending along the length of such retorts;

means for providing fluid communication between such an air level drift and locations along adjacent upper edges of retorts in the rows of retorts adjacent such air level drift;

separate production level drifts extending along the length of alternating barrier pillars interleaved between the barrier pillars in which the air level drifts are located, the production level drifts being between adjacent rows of retorts and adjacent lower edges of retorts in such adjacent rows on opposite sides of the retorts from the sides adjacent the air level drifts; and means for providing fluid communication between such a production level drift and adjacent lower edges of retorts in the rows of retorts adjacent such production level drift.

5. The retort system according to claim 1 in which the means for providing fluid communication between such an air level drift and the upper edges of retorts in adjacent rows comprises separate passages extending from the air level drift to a plurality of gas inlet openings spaced apart along the upper edges of each of the fragmented masses in such adjacent rows of retorts.

6. The retort system according to claim 5 in which the means for providing fluid communication between such a production level drift and the lower edges of such adjacent retorts comprises separate passages extending from the production level drift to a plurality of outlet openings spaced apart along the lower edges of each of the fragmented masses in such adjacent rows of retorts.

7. The retort system according to claim 4 in which the load-bearing barrier pillars are of generally uniform width.

8. The retort system according to claim 7 in which the retorts in each row are separated by partitions of unfragmented formation for substantially preventing gas flow between adjacent retorts in each row but which do not provide significantly mmore support for overburden loads than the adjacent fragmented masses.

9. A system of in situ oil shale retorts formed within a subterranean formation containing oil shale, such an in situ oil shale retort having upper, lower, and side boundaries of unfragmented formation and containing a fragmented permeable mass of formation particles containing oil shale, the retort system comprising:

a plurality of mutually spaced apart rows of such in situ oil shale retorts;

load-bearing barrier pillars of unfragmented formation separating adjacent rows of such in situ retorts from one another, such load-bearing barrier pillars being sufficiently strong for preventing substantial subsidence of overburden at elevations above the upper boundaries of such in situ oil shale retorts;

separate air level drifts excavated in alternating barrier pillars and extending along the length of such pillars between adjacent rows of such retorts adjacent upper edges of the retorts in such adjacent rows;

separate production level drifts excavated along the length of intervening barrier pillars between the barrier pillars in which the air level drifts are excavated, the production level drifts being between adjacent rows of retorts and extending adjacent lower edges of the retorts in such adjacent rows, said lower edges being on opposite sides of such retorts from the sides adjacent the air level drifts;

means for providing fluid communication between such an air level drift and adjacent upper edges of retorts in the rows of retorts adjacent such air level drift, so that fluid communication with the upper edge of such a retort is on one side of the retort; and means for providing fluid communication between such production level drift and adjacent lower edges of retorts in the rows of retorts adjacent such production level drift, so that fluid communication with the lower corner of such a retort is on one side of the retort and on the side opposite from the side that communicates with the corresponding air level drift.

10. The system according claim 9 including a plurality of inlet passages spaced apart along the upper corner of such in situ retort for providing fluid communication between the air level drift and such retort.

11. The system according to claim 9 in which retorts in each row are separated by partitions of unfragmented formation for substantially preventing gas flow between adjacent retorts in each row but which do not provide significantly more support for overburden loads than the adjacent fragmented masses.

12. A system of in situ oil shale retorts formed within a subterranean formation containing oil shale, such an in situ oil shale retort having upper, lower and side boundaries of unfragmented formation containing a fragmented permeable mass of formation particles containing oil shale, the retort system comprising:

a plurality of mutually spaced apart generally parallel rows of in situ oil shale retorts, such retorts being generally rectangular in horizontal cross section and having a longer length and a shorter width, the retorts in each row being arranged with their lengths extending generally parallel to the length of the row of retorts;

load-bearing barrier pillars of unfragmented formation separating adjacent rows of such in situ retorts from one another, such load-bearing pillars being sufficiently strong for preventing substantial subsidence of overburden at elevations above the upper boundaries of such in situ retorts;

separate air level drifts extending along the length of alternating barrier pillars between adjacent rows of such retorts adjacent upper edges of retorts in such adjacent rows, said upper edges extending along the length of such retorts;

means for providing fluid communication between such an air level drift and locations along adjacent upper edges of retorts in the rows of retorts adjacent such air level drift, so that fluid communication with the upper edge of such retort is on one side of the retort;

separate production level drifts extending along the length of alternating barrier pillars interleaved between the barrier pillars in which the air level drifts are located, the production level drifts being between adjacent rows of retorts and adjacent lower edges of retorts in such adjacent rows on opposite sides of the retorts from the sides adjacent the air level drifts; and means for providing fluid communication between such a production level drift and adjacent lower edges of retorts in the rows of retorts adjacent such production level drift, so that fluid communication with the lower edge of such retort is on one side of the retort and on the side opposite from the side that communicates with the corresponding air level drift.

13. The retort system according to claim 12 in which the means for providing fluid communication between such an air level drift and the upper edges of retorts in adjacent rows comprises separate passages extending from the air level drift to a plurality of gas inlet openings spaced apart along the upper edges of each of the fragmented masses in such adjacent rows of retorts.

14. The retort system according to claim 13 in which the means for providing fluid communication between such a production level drift and the lower edges of such adjacent retorts comprises separate passages extending from the production level drift to a plurality of outlet openings spaced apart along the lower edges of each of the fragmented masses in such adjacent rows of retorts.

15. The retort system according to claim 12 in which the load-bearing barrier pillars are of generally uniform width.

16. The retort system according to claim 15 in which the retorts in each row are separated by partitions of unfragmented formation for substantially preventing gas flow between adjacent retorts in each row but which do not provide significantly more support for overburden loads than the adjacent fragmented masses.

17. A method for recovering liquid and gaseous products from a system of in situ oil shale retorts formed in a subterranean formation containing oil shale, such an in situ oil shale retort having upper, lower and side boundaries of unfragmented formation and containing a fragmented permeable mass of formation particles containing oil shale, the method comprising the steps of:

forming a plurality of mutually spaced apart rows of such in situ oil shale retorts, leaving load-bearing barrier pillars of unfragmented formation separating adjacent rows of such in situ retorts from one another, such load-bearing barrier pillars being sufficiently strong for preventing substantial subsidence of overburden at elevations above the upper boundaries of such in situ oil shale retorts;

excavating separate air level drifts in alternating barrier pillars so that such air level drifts extend along the length of such pillars between adjacent rows of such retorts adjacent upper edges of the retorts in such adjacent rows;

excavating separate production level drifts along the length of intervening barrier pillars between the barrier pillars in which the air level drifts are excavated, the production level drifts being excavated between adjacent rows of retorts and extending adjacent lower edges of the retorts in such adjacent rows, said lower edges being on opposite sides of such retorts from the sides adjacent the air level drifts;

providing fluid communication between such an air level drift and adjacent upper edges of retorts in the rows of retorts adjacent such air level drift;

providing fluid communication between such a production level drift and adjacent lower edges of retorts in the rows of retorts adjacent such production level drift;

establishing a combustion zone in an upper portion of each of such retorts;

introducing an oxygen-supplying gas from the air level drifts to the upper edges of retorts in the rows of retorts adjacent the air level drifts for advancing the combustion zones diagonally through the fragmented masses in such retorts, and establishing a retorting zone on the advancing side of each such combustion zone for producing liquid and gaseous products of retorting; and withdrawing the liquid and gaseous products from the lower edges of each of the retorts to the production level drift, such withdrawal of gaseous products causing each such combustion zone to advance diagonally downwardly through the fragmented mass from the upper edge toward the lower edge of the fragmented mass.

18. The method according to claim 17 in which substantially all of the oxygen-supplying gas introduced to each retort from its corresponding air level drift is introduced to such adjacent upper edge of the retort, and in which substantially all of the gaseous products withdrawn from the retort are withdrawn from the lower edge of the retort on the side of the retort opposite the side to which the oxygen-supplying gas is introduced for advancing the combustion zone diagonally through the retort.

19. The method according to claim 17 comprising introducing the oxygen-supplying gas to locations spaced apart along substantially the entire length of the upper edge of the retort.

20. The method according to claim 17 including advancing the combustion zone diagonally through the retort by causing gas flow through the retort to flow predominantly from the upper edge on one side of the retort toward the lower edge on the opposite side of the retort.

21. A method for recovering liquid and gaseous products from an in situ oil shale retort formed in a subterranean formation containing oil shale, such an in situ oil shale retort having upper, lower and side boundaries of unfragmented formation and containing a fragmented permeable mass of formation particles containing oil shale, the method comprising the steps of:

forming a plurality of mutually spaced apart, generally parallel rows of in situ oil shale retorts, such retorts being generally rectangular in horizontal cross section and having a longer length and a shorter width, the retorts in each row being arranged with their lengths extending generally parallel to the length of the row of retorts; and leaving load-bearing barrier pillars of unfragmented formation separating adjacent rows of such in situ retorts from one another, such load-bearing pillars being sufficiently strong for preventing substantial subsidence of overburden at elevations above the upper boundaries of such in situ retorts;

excavating separate air level drifts extending along the length of alternating barrier pillars between adjacent rows of such retorts adjacent upper edges of retorts in such adjacent rows, said upper edges extending along the length of such retorts;

excavating separate production level drifts along the length of alternating barrier pillars interleaved between the barrier pillars in which the air level drifts are evacuated, the production level drifts being between adjacent rows of retorts and adjacent lower edges of retorts in such adjacent rows on opposite sides of the retorts from the sides adjacent the air level drifts;

providing fluid communication between such an air level drift and locations along adjacent upper edges of retorts in the rows of retorts adjacent such air level drift;

providing fluid communication between such a production level drift and adjacent lower edges of retorts in the rows of retorts adjacent such production level drift;

establishing a combustion zone in an upper portion of such a retort;

introducing an oxygen-supplying gas from such air level drift to the upper edge of such retort for advancing the combustion zone diagonally through the fragmented mass in such retort and establishing a retorting zone on the advancing side of the combustion zone for producing liquid and gaseous products of retorting; and withdrawing the liquid and gaseous products of retorting from said lower edge of such retort to the adjacent production level drift, such withdrawal of gaseous products causing the combustion zone to advance diagonally downwardly through such retort from the upper edge toward the lower edge of the fragmented mass.

22. The method according to claim 21 in which substantially all of the oxygen-supplying gas introduced to such retort from its corresponding air level drift is introduced to the adjacent upper edge of the retort, and in which substantially all of the gaseous products withdrawn from the retort are withdrawn from the lower edge of the retort on the side of the retort opposite the side to which the oxygen-supplying gas is introduced for advancing the combustion zone diagonally through the retort.

23. The method according to claim 21 comprising introducing the oxygen-supplying gas to locations spaced apart substantially along essentially the entire length of the upper edge of the retort.

24. The method according to claim 21 including advancing the retorting zone diagonally through the retort by causing gas flow through the retort to flow predominantly from the upper edge on one side of the retort toward the lower edge on the opposite side of the retort.

* * * * *

UNITED STATES PATENT AND TRADEMARK OFFICE

CERTIFICATE OF CORRECTION

PATENT NO. : 4,441,759

DATED : April 10, 1984

INVENTOR(S) : NED M. HUTCHINS; IRVING G. STUDEBAKER; RUDOLF KVAPIL; THOMAS E. RICKETTS

It is certified that error appears in the above-identified patent and that said Letters Patent is hereby corrected as shown below:

In the specifications, Column 4, line 49, change "or" to -- of --. Column 7, line 28, change "exygen" to -- oxygen --. Column 9, line 11, change "feed" to -- feet --; line 19, change "comprises" to -- comprise --.

In the claims, Column 11, line 37, claim 1, change "edge" to -- edges --. Column 12, line 21, claim 5, change "claim 1" to -- claim 4 --; line 43, claim 8, change "mmore" to -- more --. Column 13, line 16, claim 10, change "corner" to -- edge--.

Signed and Sealed this

*Ninth* Day of *July 1985*

[SEAL]

*Attest:*

DONALD J. QUIGG

*Attesting Officer* *Acting Commissioner of Patents and Trademarks*